US011319756B2

(12) United States Patent
Egbe et al.

(10) Patent No.: US 11,319,756 B2
(45) Date of Patent: May 3, 2022

(54) HYBRID REAMER AND STABILIZER

(71) Applicant: Saudi Arabian Oil Company, Dhahran (SA)

(72) Inventors: Peter Ido Egbe, Abqaiq (SA); Victor Jose Bustamante Rodriguez, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/997,366

(22) Filed: Aug. 19, 2020

(65) Prior Publication Data

US 2022/0056764 A1 Feb. 24, 2022

(51) Int. Cl.

| | |
|---|---|
| ***E21B 10/32*** | (2006.01) |
| ***E21B 17/10*** | (2006.01) |
| ***E21B 10/567*** | (2006.01) |

(52) U.S. Cl.

CPC ..... *E21B 10/325* (2013.01); *E21B 10/567* (2013.01); *E21B 17/1057* (2013.01)

(58) Field of Classification Search

CPC ..... E21B 10/325; E21B 10/34; E21B 17/1057
See application file for complete search history.

(56) References Cited

U.S. PATENT DOCUMENTS

| | | | | |
|---|---|---|---|---|
| 1,548,543 | A | 8/1925 | Moody | |
| 1,804,850 | A | 5/1931 | Cambell et al. | |
| 2,014,563 | A | 9/1935 | Halliburton | |
| 2,058,688 | A | 10/1936 | Halliburton | |
| 2,173,037 | A | 9/1939 | Dailey | |
| 2,180,589 | A * | 11/1939 | Hodges | E21B 10/325 175/277 |
| 2,694,450 | A | 11/1954 | Osbun | |
| 2,754,136 | A | 7/1956 | Newton | |
| 2,801,715 | A | 8/1957 | Hall | |
| 2,865,605 | A | 12/1958 | Chadderdon | |
| 3,690,163 | A | 9/1972 | Shannon et al. | |
| 4,185,704 | A * | 1/1980 | Nixon, Jr. | E21B 7/068 175/325.2 |

(Continued)

FOREIGN PATENT DOCUMENTS

| | | |
|---|---|---|
| AU | 1977028454 | 3/1979 |
| CA | 2462154 | 9/2005 |

(Continued)

OTHER PUBLICATIONS

"Bladed Drilling Reamer," Paradigm Drilling Services Ltd., 2016, 3 pages.

(Continued)

*Primary Examiner* — Shane Bomar
(74) *Attorney, Agent, or Firm* — Fish & Richardson P.C.

(57) ABSTRACT

An apparatus for cutting into a subterranean formation includes a body and multiple cutting blades distributed around a circumference of the body. The cutting blades are configured to cut into the subterranean formation in response to being rotated. Each cutting blade includes a ball embedded in the respective cutting blade. At least a portion of the ball protrudes towards the subterranean formation from the respective cutting blade in which the ball is embedded. Each ball is configured to roll against the subterranean formation to reduce friction while the cutting blades are rotating.

11 Claims, 6 Drawing Sheets

(56) References Cited

U.S. PATENT DOCUMENTS

| | | | | |
|---|---|---|---|---|
| 4,262,760 | A | 4/1981 | Allison et al. | |
| 4,433,738 | A | 2/1984 | Moreland | |
| 4,440,019 | A | 4/1984 | Marshall | |
| 4,441,556 | A | 4/1984 | Powers et al. | |
| 4,771,832 | A | 9/1988 | Bridges | |
| 4,958,692 | A * | 9/1990 | Anderson | E21B 4/003 175/323 |
| 4,991,668 | A | 2/1991 | Rehm et al. | |
| 5,314,015 | A | 5/1994 | Streich et al. | |
| 5,439,064 | A | 8/1995 | Patton | |
| 5,522,467 | A * | 6/1996 | Stevens | E21B 17/1057 175/325.3 |
| 5,692,563 | A * | 12/1997 | Krueger | E21B 17/1014 166/241.6 |
| 5,715,898 | A * | 2/1998 | Anderson | E21B 17/1057 175/325.3 |
| 6,318,458 | B1 | 11/2001 | Rainey | |
| 6,578,638 | B2 | 6/2003 | Guillory et al. | |
| 7,108,080 | B2 | 9/2006 | Tessari et al. | |
| 7,389,183 | B2 | 6/2008 | Gray | |
| 7,581,595 | B2 | 9/2009 | Fay et al. | |
| 7,717,179 | B2 | 5/2010 | Rayssiguier et al. | |
| 8,028,767 | B2 | 10/2011 | Radford et al. | |
| 8,210,283 | B1 | 7/2012 | Benson et al. | |
| 8,307,889 | B2 | 11/2012 | Lewkoski | |
| 8,757,294 | B2 | 6/2014 | Johnson et al. | |
| 8,851,205 | B1 | 10/2014 | Short, Jr. et al. | |
| 9,790,749 | B2 * | 10/2017 | Chen | E21B 17/1078 |
| 9,879,523 | B2 | 1/2018 | Brown-Kerr et al. | |
| 9,970,258 | B2 | 5/2018 | Barannikow et al. | |
| 10,337,250 | B2 | 7/2019 | Turner | |
| 10,669,810 | B2 | 6/2020 | Egbe et al. | |
| 2002/0020526 | A1 * | 2/2002 | Male | E21B 17/1057 166/241.6 |
| 2009/0032241 | A1 | 2/2009 | Allen et al. | |
| 2009/0145666 | A1 * | 6/2009 | Radford | E21B 10/322 175/269 |
| 2009/0283322 | A1 | 11/2009 | Dove | |
| 2012/0279784 | A1 | 11/2012 | Harvey et al. | |
| 2013/0319684 | A1 * | 12/2013 | Moellendick | E21B 17/1057 166/378 |
| 2014/0246197 | A1 | 9/2014 | Smith et al. | |
| 2014/0262216 | A1 * | 9/2014 | Perry | E21B 17/1014 166/241.6 |
| 2015/0361731 | A1 * | 12/2015 | Wood | E21B 17/1071 166/381 |
| 2016/0076361 | A1 | 3/2016 | Wong et al. | |
| 2016/0305230 | A1 | 10/2016 | Benson et al. | |
| 2017/0009539 | A1 | 1/2017 | Helvenston et al. | |
| 2019/0040738 | A1 | 2/2019 | Ramjit et al. | |
| 2019/0162028 | A1 | 5/2019 | Shotwell | |
| 2021/0032942 | A1 * | 2/2021 | Gordon | F16C 29/046 |

FOREIGN PATENT DOCUMENTS

| | | |
|---|---|---|
| EP | 2835493 | 2/2019 |
| EP | 2594731 | 3/2019 |
| GB | 2568224 | 5/2019 |
| WO | WO 199517580 | 6/1995 |
| WO | WO 2006079166 | 8/2006 |
| WO | WO 2014182303 | 11/2014 |
| WO | WO 2015015169 | 2/2015 |
| WO | WO 2015199986 | 12/2015 |

OTHER PUBLICATIONS

"GunDRILL Reamer (GDR)," Rubicon Oilfield International, available on or before Mar. 24, 2020, 1 page.

slb.com [online], "Diamond-Enhances Insert Stabilizer," Schlumberger, available on or before Jul. 9, 2020, retrieved from URL <https://www.slb.com/drilling/bottomhole-assemblies/reamers-and-stabilizers/diamond-enhanced-stabilizer>, 3 pages.

PCT International Search Report and Written Opinion International Appln. No. PCT/US2021/046305, dated Nov. 25, 2021, 15 pages.

* cited by examiner

HYBRID REAMER AND STABILIZER

TECHNICAL FIELD

This disclosure relates to drilling in subterranean formations.

BACKGROUND

Wells are utilized for commercial-scale hydrocarbon production from source rocks and reservoirs. A well is created by drilling a hole (wellbore) into the Earth. Afterward, casing is installed in the hole. Casing provides structural integrity to the wellbore and also isolates subterranean zones from each other and from the surface of the Earth. Some wells are vertical wells, and some wells are non-vertical wells. The drilling of non-vertical wells is also referred to as directional drilling.

SUMMARY

This disclosure describes technologies relating to drilling in subterranean formations. Certain aspects of the subject matter described can be implemented as an apparatus for cutting into a subterranean formation includes a body and multiple cutting blades distributed around a circumference of the body. The cutting blades are configured to cut into the subterranean formation in response to being rotated. Each cutting blade includes a ball embedded in the respective cutting blade. At least a portion of the ball protrudes towards the subterranean formation from the respective cutting blade in which the ball is embedded. Each ball is configured to roll against the subterranean formation to reduce friction while the cutting blades are rotating.

This, and other aspects, can include one or more of the following features. In some implementations, each cutting blade defines a cavity within which the respective ball is embedded. In some implementations, each cutting blade includes a spindle positioned within the respective cavity. In some implementations, each ball is mounted to the spindle of the respective cutting blade. In some implementations, each ball is free to slide longitudinally relative to the spindle of the respective cutting blade. In some implementations, each ball is free to rotate about a longitudinal axis of the spindle of the respective cutting blade. In some implementations, each cutting blade includes a leading edge and a trailing edge with respect to a direction of rotation of the cutting blades. In some implementations, each leading edge and each trailing edge includes a polycrystalline diamond compact cutter. In some implementations, each cutting blade includes a tapered crown including a polycrystalline diamond compact cutter. In some implementations, each cutting blade is spring loaded, such that each cutting blade is biased radially outward from the body. In some implementations, each cutting blade has a straight or spiral shape.

Certain aspects of the subject matter described can be implemented as a bottom hole assembly. The bottom hole assembly includes a drill bit, a drill collar, and an apparatus. The apparatus includes a body and multiple cutting blades distributed around a circumference of the body. The cutting blades are configured to cut into a subterranean formation in response to being rotated. Each cutting blade includes a ball embedded in the respective cutting blade. At least a portion of the ball protrudes toward the subterranean formation from the respective cutting blade in which the ball is embedded. Each ball is configured to roll against the subterranean formation to reduce friction while the cutting blades are rotating.

This, and other aspects, can include one or more of the following features. In some implementations, each cutting blade defines a cavity within which the respective ball is embedded. In some implementations, each cutting blade includes a spindle positioned within the respective cavity. In some implementations, each ball is mounted to the spindle of the respective cutting blade. In some implementations, each ball is free to slide longitudinally relative to the spindle of the respective cutting blade. In some implementations, each ball is free to rotate about a longitudinal axis of the spindle of the respective cutting blade. In some implementations, each cutting blade includes a leading edge and a trailing edge with respect to a direction of rotation of the cutting blades. In some implementations, each leading edge and each trailing edge includes a polycrystalline diamond compact cutter. In some implementations, each cutting blade includes a tapered crown including a polycrystalline diamond compact cutter. In some implementations, each cutting blade is spring loaded, such that each cutting blade is biased radially outward from the body. In some implementations, each cutting blade has a straight or spiral shape. In some implementations, the drill collar is positioned longitudinally intermediate of the drill bit and the apparatus. In some implementations, the apparatus is positioned longitudinally intermediate of the drill bit and the collar.

Certain aspects of the subject matter described can be implemented as a method. During a drilling operation in a subterranean formation, a cutting blade is biased outward from a body by a spring, such that a ball embedded within and protruding from the cutting blade contacts a wall of the subterranean formation. During the drilling operation in the subterranean formation, the cutting blade is rotated to cut into the wall of the subterranean formation. The ball rolls against the wall of the subterranean formation to reduce friction while the cutting blade rotates.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

A bottom hole assembly (BHA) is the lower portion of a drill string used to create wellbores in subterranean formations. The BHA provides force for a drill bit to break rock to form the wellbore, is configured to operate in hostile mechanical environments encountered during drilling operations, and provide directional control. In some cases, a section of a wellbore changes direction faster than anticipated or desired. Such sections are also known as dog legs.

The apparatus described exhibits both reaming and stabilizing capabilities for a BHA and can be used to remove dog legs or other sections in a wellbore that otherwise restrict an inner diameter (ID) of the wellbore. The apparatus includes cutters (and in some cases, hardfacing) for reaming and roller balls for stabilizing and reducing friction during movement of the apparatus in the wellbore. In some implementations, the apparatus utilizes spring loading to improve stabilization of the BHA. The subject matter described in this disclosure can be implemented in particular implementations, so as to realize one or more of the following advantages. The apparatus described can improve wellbore condition and quality while a wellbore is being drilled, which can facilitate smooth deployment of tubulars in a well. The apparatus described can be used to re-direct a wellbore to be located in a planned path for the well. Dog legs can be removed while a wellbore is being drilled, which can save on rig time and additional costs associated with additional wiper and/or dedicated hole conditioning trips. By removing dog legs, repeated abrasion and resultant wear of tools on a drill string or casing to be installed in the wellbore can be mitigated or avoided. Further, by removing dog legs, particularly during drilling operations, can mitigate or eliminate the risk of the drill string becoming stuck or not reaching a planned total depth. The apparatus described can be implemented for vertical wells, deviated wells, and high-angle wells (for example, extended-reach drilling).

Figure 1:
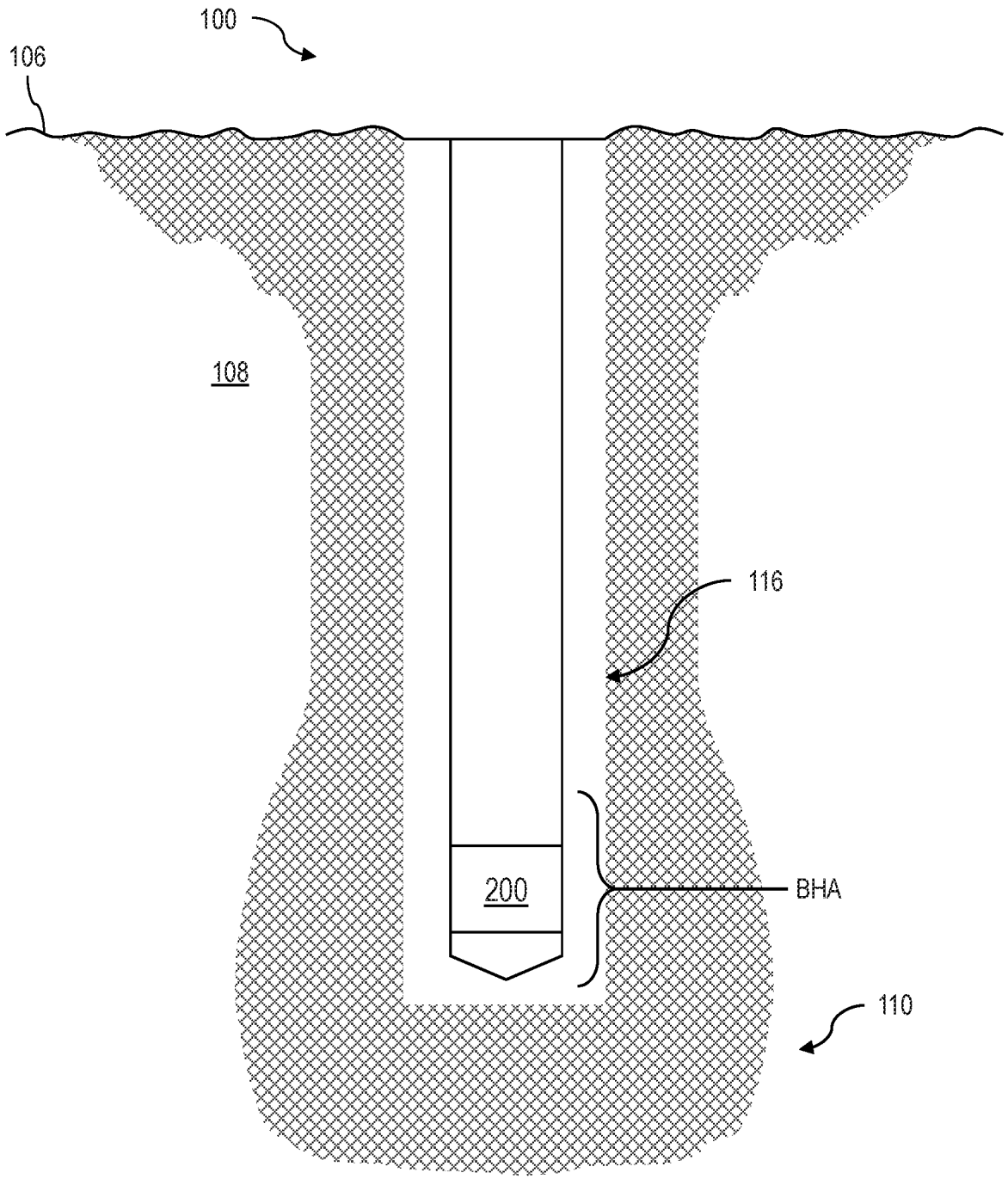
FIG. 1 is a schematic diagram of an example well.

FIG. 1 depicts an example well 100 constructed in accordance with the concepts herein. The well 100 extends from the surface 106 through the Earth 108 to one more subterranean zones of interest 110 (one shown). The well 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other types of formations, including reservoirs that are not naturally fractured. For simplicity's sake, the well 100 is shown as a vertical well, but in other instances, the well 100 can be a deviated well with a wellbore deviated from vertical (for example, horizontal or slanted), the well 100 can include multiple bores forming a multilateral well (that is, a well having multiple lateral wells branching off another well or wells), or both.

In some implementations, the well 100 is a gas well that is used in producing hydrocarbon gas (such as natural gas) from the subterranean zones of interest 110 to the surface 106. While termed a "gas well," the well need not produce only dry gas, and may incidentally or in much smaller quantities, produce liquid including oil, water, or both. In some implementations, the well 100 is an oil well that is used in producing hydrocarbon liquid (such as crude oil) from the subterranean zones of interest 110 to the surface 106. While termed an "oil well," the well not need produce only hydrocarbon liquid, and may incidentally or in much smaller quantities, produce gas, water, or both. In some implementations, the production from the well 100 can be multiphase in any ratio. In some implementations, the production from the well 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth.

Figure 2A:
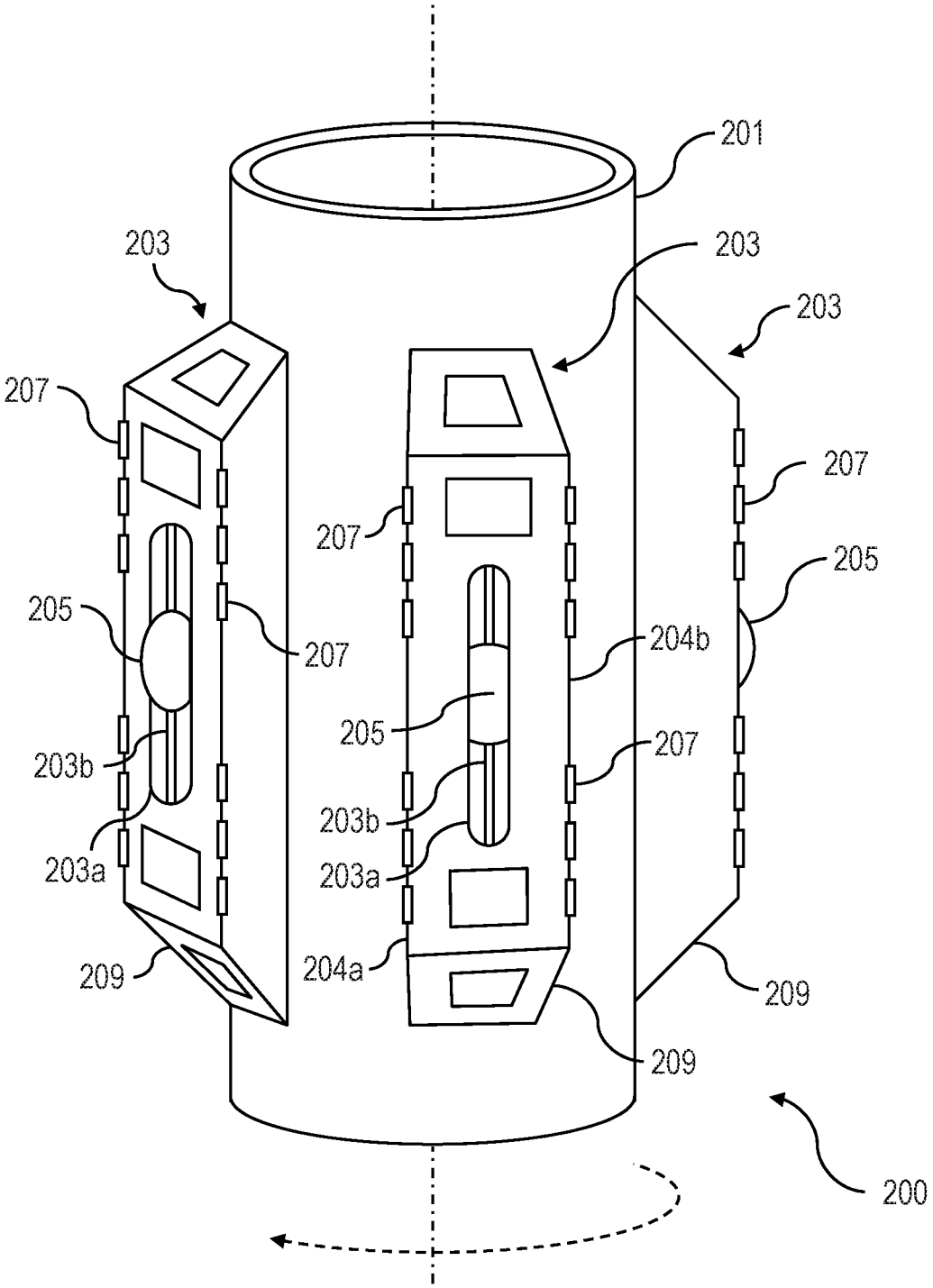
FIG. 2A is a schematic diagram of an example reaming apparatus that can be implemented in the well of FIG. 1.

FIG. 2A is a schematic diagram of an implementation of an apparatus 200 for cutting into a subterranean formation, for example, to form the well 100. The apparatus 200 includes a body 201 and multiple cutting blades 203. The cutting blades 203 can be rotated (for example, about a longitudinal axis of the body 201) to cut into the subterranean formation. Each of the cutting blades 203 include a ball 205 that is embedded in the respective cutting blade 203. At least a portion of each ball 205 protrudes outward toward the subterranean formation from its respective cutting blade 203. The balls 205 are configured to roll against the subterranean formation to reduce friction while the cutting blades 203 rotate. The apparatus 200 can provide both reaming and stabilizing functions for a BHA. The reaming capability of the apparatus 200 allows for a drill bit of a BHA to do more work on drilling while doing less work in maintaining wellbore gauge. The stabilizing capability of the apparatus 200 helps to guide the drill bit of the BHA in the hole.

The body 201 is elongate and defines a central bore for circulation of drilling fluid through the body 201. Although shown in FIG. 2A as being generally cylindrical, the body 201 can be of other geometric shapes. For example, the body 201 can have a rectangular or other polygonal cross-sectional shape. The body 201 is configured to connect (for example, by threaded connections) to other drill string components, such as a drill bit or a drill collar. The body 201 can be made of a metallic material, such as an alloy.

The cutting blades 203 are distributed around a circumference of the body 201. In some implementations, each cutting blade 203 defines a cavity 203*a* within which the respective ball 205 is embedded. In some implementations, the cavity 203*a* is a recess formed on a surface of the cutting blade 203. In some implementations, the cutting blades 203 are made from similar or the same material as the body 201.

In some implementations, each cutting blade 203 includes a spindle 203*b* that is positioned within the respective cavity 203*a*. In such implementations, each ball 205 is mounted to the spindle 203*b* of the respective cutting blade 203. The spindle 203*b* can be made of the same material as the body 201.

Each ball 205 is free to rotate about a longitudinal axis of the spindle 203*b* of the respective cutting blade 203. In some implementations, each ball 205 is free to slide longitudinally relative to the spindle 203*b* of the respective cutting blade 203. In some implementations, the spindle 203*b* is fixed to its respective cavity 203*a*. In some implementations, the spindle 203*b* is spring loaded, and a spring retains the position of the spindle 203*b* within its respective cavity 203*a*. Because the balls 205 protrude outward from the cutting blades 203, the balls 205 define an outer circumference of the apparatus 200 when rotating with the cutting blades 203.

In some implementations, each cutting blade 203 includes a leading edge 204*a* and a trailing edge 204*b* with respect to a direction of rotation of the cutting blades 203 (depicted by a dotted arrow in FIG. 2A). In some implementations, each leading edge 204*a* includes a cutter 207. In some implementations, each trailing edge 204*b* includes a cutter 207. In some implementations, the apparatus 200 includes additional cutters 207. In some implementations, each cutting blade 203 includes a tapered crown 209. In some implementations, the tapered crown 209 includes a cutter 207. When the cutting blades 203 are rotated, the cutters 207 perform the reaming function. The reaming performed while the cutting blades 203 rotate can remove a dog leg.

The cutters 207 can be included in the form of various shapes and sizes as desired. The cutters 207 are made of a material that is strong enough to cut into the subterranean formation. In some implementations, the cutters 207 are polycrystalline diamond compact (PDC) cutters. In such implementations, the cutters 207 can, for example, be in the form of PDC cutter inserts that are inserted and bonded to grooves formed in the cutting blades 203.

In some implementations, each cutting blade 203 is spring loaded, such that the cutting blades 203 are biased radially outward from the body 201. In such implementations, the spring loading can serve as a shock absorber that dampens sudden mechanical loads that the cutting blades 203 may be subjected to during drilling operations. In some implementations, as shown in FIG. 2A, each cutting blade 203 has a straight shape (for example, generally rectangular). Optionally, the shapes and sizes of the cutting blades 203 can be different from the implementation shown in FIG. 2A.

In some implementations, each cutting blade 203 includes hardfacing to mitigate wear, for example, from erosion. Hardfacing involves applying a harder/tougher material to a base to increase wear resistance. The hardfacing can be included in the form of various shapes and sizes as desired. For example, each cutting blade 203 includes hardfacing at the tapered crown 209. For example, each cutting blade 203 includes hardfacing near the leading edge 204*a*. For example, each cutting blade 203 includes hardfacing near the trailing edge 204*b*. Some examples of hardfacing materials include cobalt-based alloys (such as stellite), nickel-based alloys, chromium carbide alloys, and tungsten carbide alloys.

As the apparatus 200 travels longitudinally through a wellbore, the balls 205, which define the outer circumference of the apparatus 200, can reduce friction. As the apparatus 200 rotates within a wellbore, the balls 205 can reduce friction. The balls 205 can also reduce friction when the apparatus 200 is simultaneously rotating and traveling longitudinally through a wellbore. In implementations in which the cutting blades 203 are spring loaded, the cutting blades 203 are biased to protrude radially outward from the body 201 toward the subterranean formation. If a cutting blade 203 encounters a mechanical force that overcomes the compressive spring force, that cutting blade 203 can temporarily retract toward the body 201 and work as a shock absorber. The spring-loaded cutting blades 203 and balls 205 can work together to stabilize a BHA during drilling operations. While the apparatus 200 is rotating, the cutters 207 disposed on the cutting blades 203 perform reaming which can condition a wellbore and remove dog legs or other shape irregularities of the wellbore.

Figure 2B:
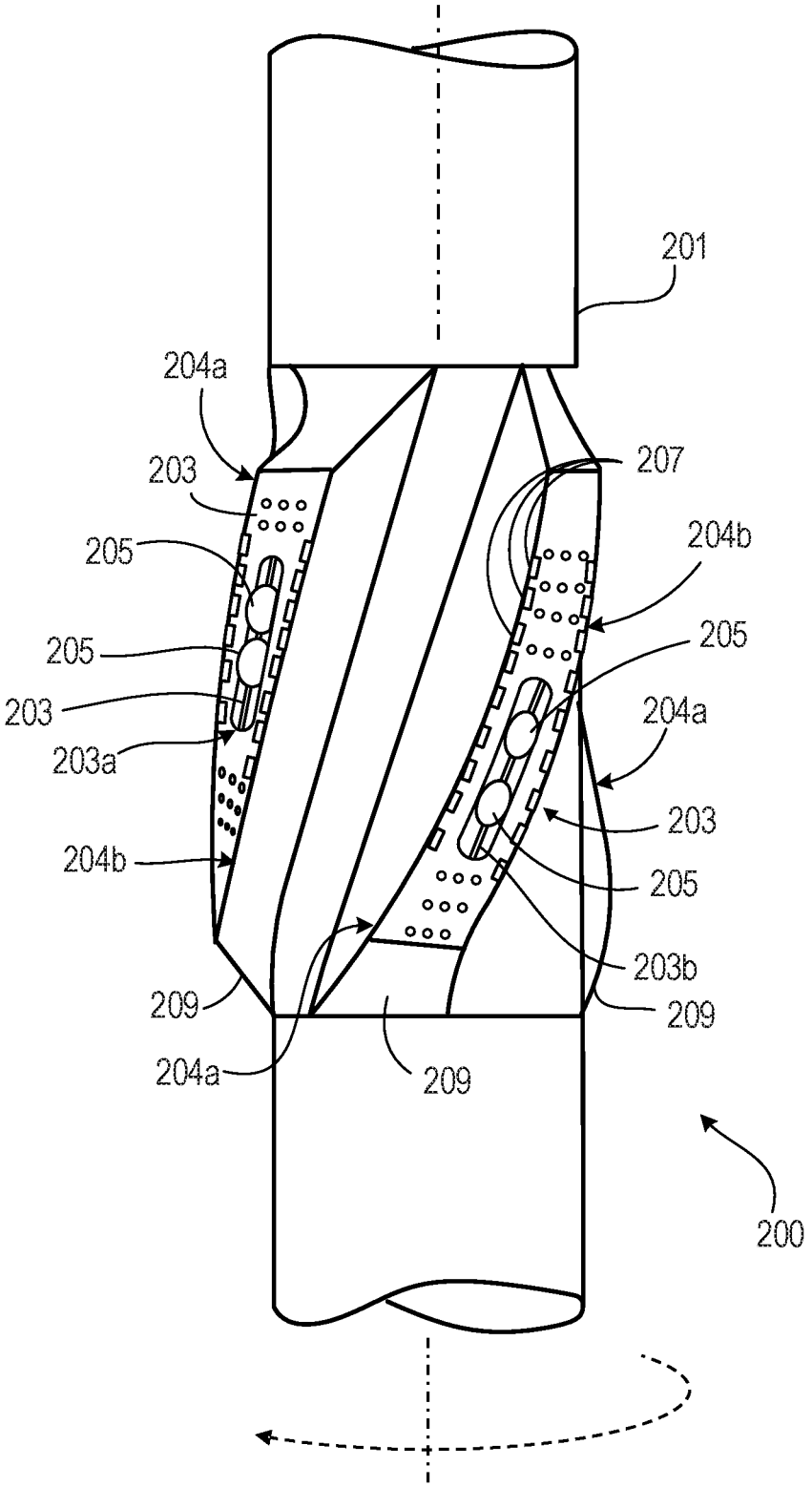
FIG. 2B is a schematic diagram of an example reaming apparatus that can be implemented in the well of FIG. 1.

FIG. 2B is a schematic diagram of another implementation of the apparatus 200. The apparatus 200 shown in FIG. 2B is substantially similar to the apparatus 200 shown in FIG. 2A. As described previously, the apparatus 200 includes a body 201 and multiple cutting blades 203. The cutting blades 203 cut into the subterranean formation as they rotate. Each of the cutting blades 203 include a ball 205 that is embedded in the respective cutting blade 203. At least a portion of each ball 205 protrudes toward the subterranean formation from its respective cutting blade 203. The balls 205 are configured to roll against the subterranean formation to reduce friction while the cutting blades 203 rotate. In some implementations, as shown in FIG. 2B, each cutting blade 203 has a spiral shape that wraps around the body 201 (for example, similar to a thread of a screw).

In some implementations, as shown in FIG. 2B, each cutting blade 203 includes two balls 205 that are mounted on a single spindle 203*b* positioned within a respective cavity 203*a*. Although shown in FIG. 2B as including two balls 205, each cutting blade 203 can include more than two balls 205 mounted on a respective spindle 203*b*, for example, three or more balls 205. In implementations where multiple balls 205 are mounted on a single spindle 203*b*, the balls 205 can be free to slide longitudinally with respect to the respective spindle 203*b*, or the balls 205 can be fixed longitudinally with respect to the respective spindle 203*b*. In either case, the balls 205 are free to rotate about the longitudinal axis of the respective spindle 203*b*.

In some implementations, the spindles 203*b* are omitted. In such implementations, each cavity 203*a* can be shaped as a pathway through which the ball 205 (or multiple balls 205) disposed within the respective cavity 203*a* can move, while also being free to roll without rotational restrictions to any particular axis (for example, rotation of the ball 205 is not restricted to rotation about a longitudinal axis of the spindle 203*b*). For example, each cavity 203*a* can have a shape that is similar to the inverse shape of a pill. In some implementations, each cavity 203*a* has a shape that is similar to the inverse shape of a sphere, such that the respective ball 205 resides within the cavity 203*a* and is free to roll in any direction. Regardless of the shape of the cavities 203*a*, at least a portion of each ball 205 protrudes outwardly from the respective cavity 203*a* of the cutting blade 203 toward the subterranean formation.

Figure 3A:
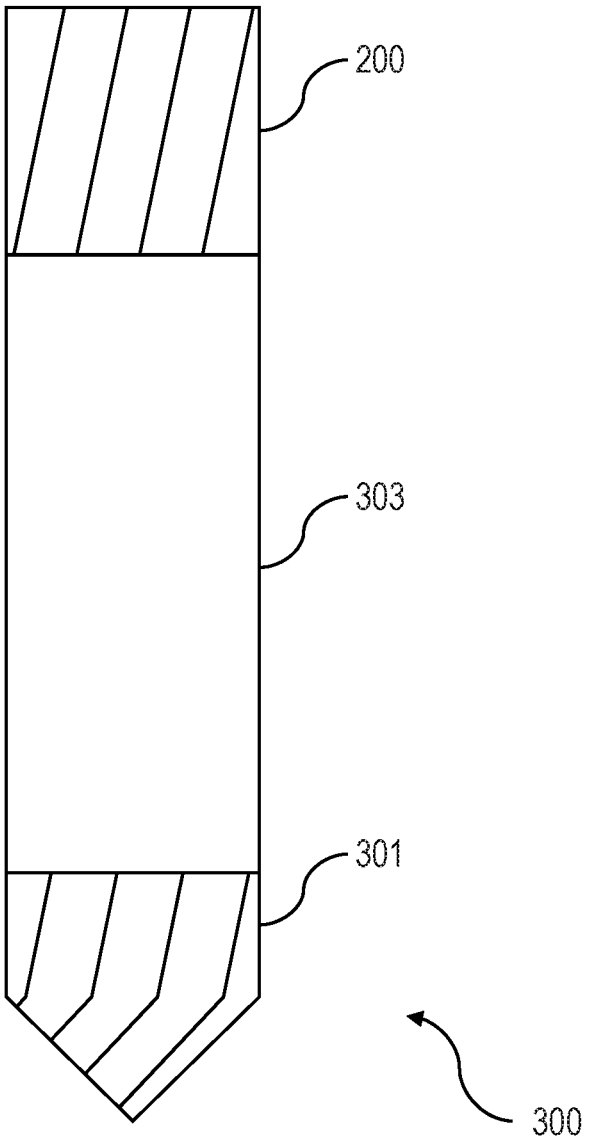
FIG. 3A is a schematic diagram of an example system that can be implemented in the well of FIG. 1.
Figure 3B:
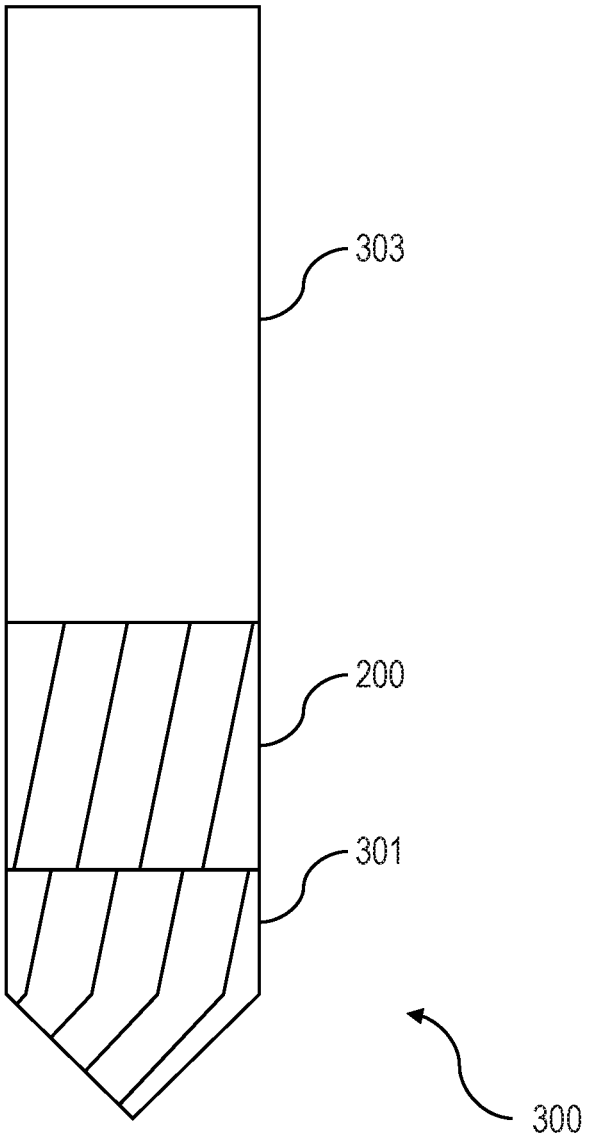
FIG. 3B is a schematic diagram of an example system that can be implemented in the well of FIG. 1.

FIGS. 3A and 3B are schematic diagrams of implementations of a BHA 300 that include the apparatus 200. The BHA 300 includes a drill bit 301, a drill collar 303, and the apparatus 200. The drill bit 301 is used to drill into a subterranean formation to form a wellbore. The drill bit 301 can be rotated to scrape rock, crush rock, or both. The drill collar 303 provides weight on the drill bit 301 to facilitate the drilling process. In some implementations, as shown in FIG. 3A, the drill collar 303 is positioned longitudinally intermediate of the drill bit 301 and the apparatus 200. In some implementations, as shown in FIG. 3B, the apparatus 200 is positioned longitudinally intermediate of the drill bit 301 and the drill collar 303.

Some examples of additional components that can be included in the BHA 300 include a crossover, a heavy wall (heavy-weight) drill pipe, and an additional reamer tool. For example, the BHA 300 can include, in the following order starting from the bottom: the drill bit 301, an additional reamer tool, the drill collar 303, the apparatus 200, two additional drill collars, a crossover, and a heavy wall drill pipe that is connected to a remainder of the drill string. For example, the BHA 300 can include, in the following order starting from the bottom: the drill bit 301, the apparatus 200, the drill collar 303, an additional implementation of the apparatus 200, two additional drill collars, a crossover, and a heavy wall drill pipe that is connected to a remainder of the drill string.

Figure 4:
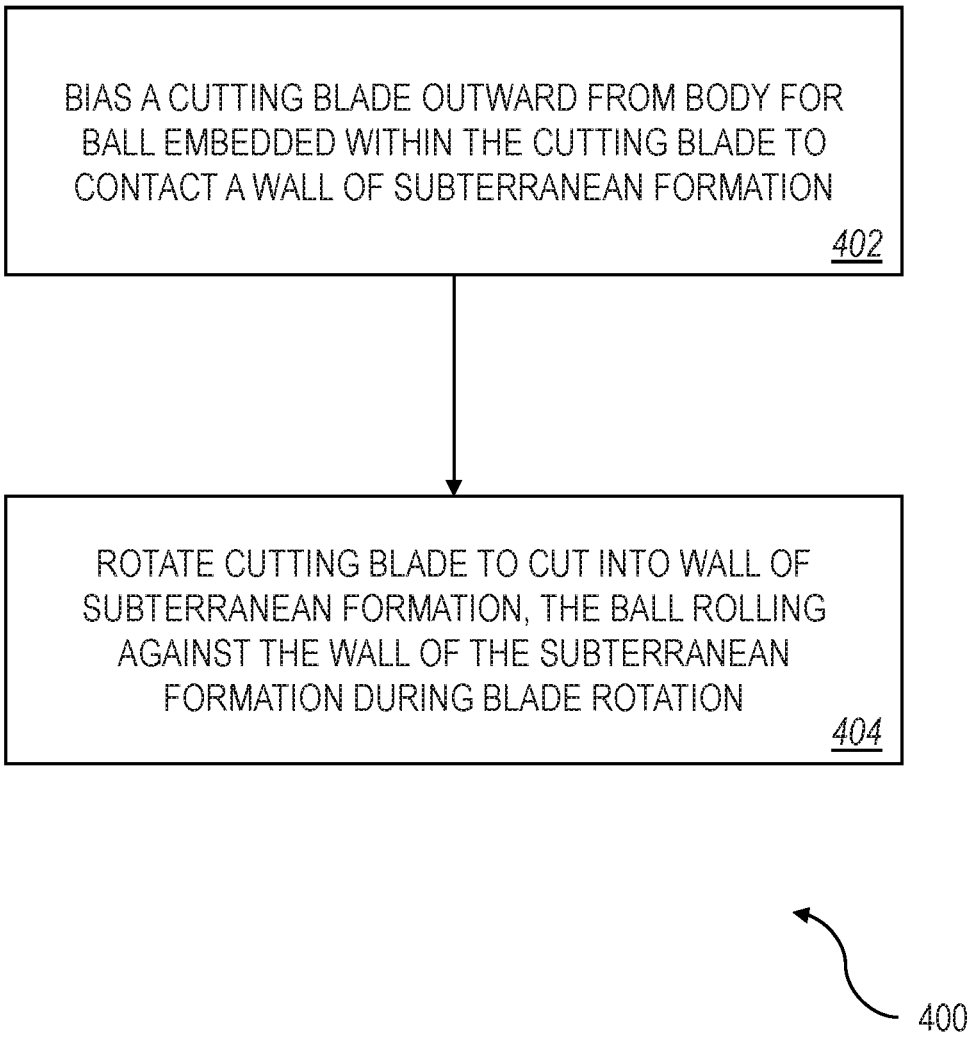
FIG. 4 is a flow chart of an example method that can be implemented in the well of FIG. 1.

FIG. 4 is a flow chart of a method 400 that can, for example, be implemented by the apparatus 200 in the well 100. The method 400 occurs during a drilling operation in a subterranean formation (for example, while the well 100 is being drilled). At step 402, a cutting blade (such as the cutting blade 203) is biased outward from a body (for example, the body 201) by a spring, such that a ball (for example, the ball 205) embedded within the cutting blade 203 and protruding from the cutting blade 203 contacts a wall of the subterranean formation. For example, the cutting blade 203 is spring loaded, such that the cutting blade 203 is biased radially outward from the body 201 toward the wall of the subterranean formation. As described previously, the ball 205 can be embedded within a cavity 203*a* in such a way that at least a portion of the ball 205 protrudes from the cutting blade 203. The spring loading of the cutting blade 203 puts the ball 205 in contact with the wall of the subterranean formation.

At step 404, the cutting blade 203 is rotated to cut into the wall of the subterranean formation. The ball 205, which is also in contact with the wall of the subterranean formation, rolls against the wall of the subterranean formation to reduce friction while the cutting blade 203 rotates at step 404. As described previously, the cutting blade 203 can include a cutter 207 that is made of a material that is strong enough to cut into the wall of the subterranean formation. For example, the cutting blade 203 includes multiple PDC cutters embedded on a surface of the cutting blade 203, and when the cutting blade 203 rotates, the cutters 207 cut into the subterranean formation. In some implementations, the ball 205 rolls against the wall of the subterranean formation to reduce friction while the apparatus 200 is moving longitudinally through the wellbore and while the cutting blade 203 is not rotating.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. An apparatus for cutting into a subterranean formation, the apparatus comprising:

a body;

a plurality of cutting blades distributed around a circumference of the body, the plurality of cutting blades configured to cut into the subterranean formation in response to being rotated, each cutting blade of the plurality of cutting blades comprising a ball embedded in the respective cutting blade, wherein at least a portion of the ball protrudes toward the subterranean formation from the respective cutting blade in which the ball is embedded, and each ball is configured to roll against the subterranean formation to reduce friction while the plurality of cutting blades are rotating, wherein each cutting blade of the plurality of cutting blades defines a cavity within which the respective ball is embedded, wherein each cutting blade of the plurality of cutting blades comprises a spindle positioned within the respective cavity, each ball is mounted to the spindle of the respective cutting blade, each ball is free to slide longitudinally relative to the spindle of the respective cutting blade, and each ball is free to rotate about a longitudinal axis of the spindle of the respective cutting blade.

2. The apparatus of claim 1, wherein each cutting blade of the plurality of cutting blades comprises a leading edge and a trailing edge with respect to a direction of rotation of the plurality of cutting blades, each leading edge and each trailing edge comprising a polycrystalline diamond compact cutter.

3. The apparatus of claim 2, wherein each cutting blade of the plurality of cutting blades comprises a tapered crown comprising a polycrystalline diamond compact cutter.

4. The apparatus of claim 3, wherein each cutting blade of the plurality of cutting blades has a straight or spiral shape.

5. A bottom hole assembly comprising:

a drill bit;

a drill collar; and an apparatus comprising:

a body;

a plurality of cutting blades distributed around a circumference of the body, the plurality of cutting blades configured to cut into a subterranean formation in response to being rotated, each cutting blade of the plurality of cutting blades comprising a ball embedded in the respective cutting blade, wherein at least a portion of the ball protrudes toward the subterranean formation from the respective cutting blade in which the ball is embedded, and each ball is configured to roll against the subterranean formation to reduce friction while the plurality of cutting blades are rotating, wherein each cutting blade of the plurality of cutting blades defines a cavity within which the respective ball is embedded, wherein each cutting blade of the plurality of cutting blades comprises a spindle positioned within the respective cavity, each ball is mounted to the spindle of the respective cutting blade, each ball is free to slide longitudinally relative to the spindle of the respective cutting blade, and each ball is free to rotate about a longitudinal axis of the spindle of the respective cutting blade.

6. The bottom hole assembly of claim 5, wherein each cutting blade of the plurality of cutting blades comprises a leading edge and a trailing edge with respect to a direction of rotation of the plurality of cutting blades, each leading edge and each trailing edge comprising a polycrystalline diamond compact cutter.

7. The bottom hole assembly of claim 6, wherein each cutting blade of the plurality of cutting blades comprises a tapered crown comprising a polycrystalline diamond compact cutter.

8. The bottom hole assembly of claim 7, wherein each cutting blade of the plurality of cutting blades has a straight or spiral shape.

9. The bottom hole assembly of claim 8, wherein the drill collar is positioned longitudinally intermediate of the drill bit and the apparatus.

10. The bottom hole assembly of claim 8, wherein the apparatus is positioned longitudinally intermediate of the drill bit and the drill collar.

11. A method comprising:

positioning a plurality of cutting blades around a circumference of a body, the plurality of cutting blades configured to cut into a subterranean formation during a drilling operation in the subterranean formation, each cutting blade comprising a ball embedded in the respective cutting blade, wherein at least a portion of the ball protrudes toward the subterranean formation from the respective cutting blade in which the ball is embedded, and each ball is configured to roll against the subterranean formation to reduce friction while the plurality of cutting blades are rotating, wherein each cutting blade of the plurality of cutting blades comprises a spindle positioned within the respective cavity, each ball is mounted to the spindle of the respective cutting blade, each ball is free to slide longitudinally relative to the spindle of the respective cutting blade, and each ball is free to rotate about a longitudinal axis of the spindle of the respective cutting blade; and rotating the cutting blade to cut into the wall of the subterranean formation, wherein the ball rolls against the wall of the subterranean formation to reduce friction while the cutting blade rotates.

* * * * *